US011846115B2

(12) United States Patent
Vingerhoets

(10) Patent No.: US 11,846,115 B2
(45) Date of Patent: Dec. 19, 2023

(54) MODULAR FENCING SYSTEM WITH GATED ACCESS

(71) Applicant: Frank Vingerhoets, Blue Point, NY (US)

(72) Inventor: Frank Vingerhoets, Blue Point, NY (US)

( * ) Notice: Subject to any disclaimer, the term of this patent is extended or adjusted under 35 U.S.C. 154(b) by 0 days.

(21) Appl. No.: 17/563,446

(22) Filed: Dec. 28, 2021

(65) Prior Publication Data

US 2022/0205273 A1 Jun. 30, 2022

Related U.S. Application Data

(60) Provisional application No. 63/132,641, filed on Dec. 31, 2020.

(51) Int. Cl.

| | |
|---|---|
| ***E04H 17/18*** | (2006.01) |
| ***E04H 17/20*** | (2006.01) |
| ***E04H 17/00*** | (2006.01) |

(52) U.S. Cl.

CPC ..... *E04H 17/185* (2021.01); *E04H 17/009* (2021.01); *E04H 17/20* (2013.01)

(58) Field of Classification Search

CPC ... E04H 17/185; E04H 17/009; E04H 17/013; E04H 17/17; E04F 11/1855; E06B 11/021

See application file for complete search history.

(56) References Cited

U.S. PATENT DOCUMENTS

| | | | | | |
|---|---|---|---|---|---|
| 2,206,625 | A * | 7/1940 | Beach | E04H 17/22 | 52/165 |
| 3,020,023 | A * | 2/1962 | MacIntyre | E01F 13/022 | 256/25 |
| 3,776,521 | A * | 12/1973 | Weinert | E04G 21/3233 | 256/59 |
| 3,809,371 | A * | 5/1974 | Martini | E04H 17/124 | 24/373 |
| 3,962,827 | A * | 6/1976 | Chaffee | E05D 1/04 | 16/365 |
| 5,476,133 | A * | 12/1995 | Torkelson | E04H 17/06 | 292/84 |
| 5,551,205 | A * | 9/1996 | Kidder | E04H 17/163 | 52/716.8 |
| 5,758,868 | A * | 6/1998 | Shea | E01F 7/02 | 256/45 |

(Continued)

FOREIGN PATENT DOCUMENTS

| | | | | |
|---|---|---|---|---|
| EP | 2362038 A1 * | 8/2011 | ..... | E04H 17/161 |
| FR | 2915224 A1 * | 10/2008 | ..... | E04H 17/16 |
| GB | 2579015 A * | 6/2020 | ..... | E04H 17/10 |

*Primary Examiner* — Matthew R McMahon

(74) *Attorney, Agent, or Firm* — Betsy Kingsbury Dowd, Esq; BKDowd Law, P.C.

(57) ABSTRACT

A modular, removable, and tool-free, user-installable fencing system includes modular, stand-alone bases that avoid the need to drill into or permanently modify expensive pool decks to secure the fence in place. The system includes fencing modules which include fence panels and a secure-access gate module that can be positioned and repositioned anywhere along the fence. The fence modules and gate modules are connected via hinge clips assembled onto the fence panels and poles inserted through the hinge clips and into the modular bases. The hinge clips allow rotation of the fence panels around the poles.

18 Claims, 9 Drawing Sheets

(56) References Cited

U.S. PATENT DOCUMENTS

| | | | | |
|---|---|---|---|---|
| 6,554,257 | B1 * | 4/2003 | Kenton | E04H 17/18 256/65.14 |
| 6,789,786 | B1 * | 9/2004 | Schatzberg | E04H 4/06 256/25 |
| 7,334,957 | B2 * | 2/2008 | Sadinsky | E04H 12/2269 403/109.8 |
| 7,740,233 | B1 * | 6/2010 | Larsen | E04H 17/161 256/45 |
| 7,946,066 | B2 * | 5/2011 | Wamsley | G09F 7/00 40/607.02 |
| 8,579,262 | B2 * | 11/2013 | Sadinsky | E04H 17/009 256/26 |
| 9,359,787 | B2 * | 6/2016 | Callahan | E05B 65/0007 |
| 9,458,645 | B1 * | 10/2016 | King | E04H 17/163 |
| 9,617,771 | B2 * | 4/2017 | Gill | E04G 5/145 |
| 2005/0218393 | A1 * | 10/2005 | Larsen | E04H 17/161 256/32 |
| 2006/0231821 | A1 * | 10/2006 | Gavin | E06B 11/02 256/73 |

* cited by examiner

MODULAR FENCING SYSTEM WITH GATED ACCESS

CROSS-REFERENCE TO RELATED APPLICATIONS

This application claims the benefit of and priority to U.S. Provisional Application Ser. No. 63/132,641 entitled "MODULAR FENCING SYSTEM WITH GATED ACCESS," filed Dec. 31, 2021, the entirety of which is hereby incorporated herein by reference thereto.

FIELD OF DISCLOSURE

The present disclosure relates generally to fencing for preventing unwanted access to in-ground pools and, in particular, to modular fencing systems for preventing young children from unwanted access to in-ground pools.

BACKGROUND

Fencing is a standard requirement for preventing access to in-ground pools, and systems of permanent fencing that require drilling posts or some kind of attaching elements or sockets into a deck surrounding the pool have been in use for years. Removable pool fences have been available for over twenty years, but until recently, such systems still required drilling sockets or other elements into the ground or deck for removably mounting posts. For an average length of traditional fence, approximately 125' in length and including one gate, for example, an average of 50 holes would need to be drilled into the pool deck. Such systems also allowed no room for changing the location and configuration of either the barrier fence, or of an access gate, once installed.

More recently, systems of stand-alone type fencing have been developed that avoid the need to permanently modify the surrounding ground or deck. However, these fences still must be installed by a professional, and are not truly modular or easily configurable by a home owner. In addition, some of the fencing systems do not provide adequate protection or gating systems for secure access. For example, U.S. Pat. No. 9,458,645 to King et al. provides a sectional fencing system which does not include modular, separate connectors to connect the fencing panels, but instead requires custom-made fence panels, each having an integrated U-shaped clamp disposed on the sidewalls of the fencing panels (See Col. 3: 33-36). Accordingly, the overall shape of the fencing installed is limited by the size/length of the fencing panels and the degree of rotation allowed by the orientation of the clamps. Further, King does not disclose any type of gate, and does not even disclose creating a secure enclosure with a gate for controlled access into the enclosure, or a secure gate that may be positioned, and repositioned, anywhere in the fencing system.

Accordingly, there is a need for a stand-alone, modular, and reconfigurable secure-access gated fencing system that is easily installed by a user without tools, and without damaging the surrounding ground or deck, and that is configurable into any position or shape, including the gate position.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a secure-access gated fencing system, for preventing unwanted access to in-ground pools, for example. The system is a stand-alone and fully modular fencing system, which is installable and reconfigurable into any position or shape desired by a user without the need for any tools, and without damage to the surrounding ground or deck.

The system can be positioned around the perimeter of an in-ground pool by a homeowner, for example, without the need for tools, and without breaching the surrounding deck or grounds.

The system is of modular design and may include at least one gate module and a plurality of fence modules. Each fence module for assembling the fencing system may include the following unitary elements, and is configured to interconnect with adjacent fence modules and with the at least one gate module to form the modular secure-access gated fence: a vertical pole; a fence panel; a base; and at least one pair of hinge clips. Each hinge clip includes an aperture or through-hole for positioning the vertical pole therethrough and a clip portion, preferably configured for snap-fit, or click-in, assembly to one of the fence panels. The base is self-standing, enables the fencing system to be self-standing, and avoids the need to drill into or permanently modify expensive pool decks.

The gate module, which is also a self-standing unit, forms a hinged barrier for access to the interior of the fenced area formed by the assembled fencing system, and includes an access panel formed of any suitable type of fencing, e.g., a welded mesh. The gate module may also include a first post with hinged attachment to the access panel, and a second post configured with a latching system.

In embodiments, each pole is preferably connected to a free-standing base.

The gate module also preferably includes a fence panel section attached to each of the first post and the second post along its outer edge. The fence panel sections, like the fence panels, are configured to connect to any adjoining fence module via the hinge clips.

The fence panels may include a welded wire mesh portion formed of vertical and horizontal wires, or rods, which in further aspects, may be formed of steel.

The present disclosure is also directed to a modular fencing system, which includes a first fence panel and a second fence panel adjacent the first fence panel. A pole is operably connected to the first fence panel and to the second fence panel, with the pole being positioned between the first fence panel and the second fence panel. The system also includes a first hinge clip removably connected to the pole and to the first fence panel adjacent the pole, the first hinge clip including a positioning portion for inserting the pole therethrough and a clip portion removably connected to a portion of the first fence panel. The clip portion preferably includes a slot with an open end configured to slide over a first side of the first fence panel and a closed end forming an end wall of the slot. The clip portion also includes a deflectable arm including an anchored end portion anchored to the clip portion along a first sidewall of the slot and proximate the open end; and a deflectable end portion extending from the anchored end portion toward the end wall and protruding from the first sidewall and into the slot. A vertical channel is formed between the end wall of the slot and the deflectable end portion. The portion of the first fence panel to which the first hinge clip is removably connected is captured within the vertical channel of the clip portion.

In embodiments, the first fence panel includes a plurality of vertical rods, and the portion of the first fence panel captured within the vertical channel is one of the plurality of vertical rods.

The positioning portion, in embodiments of the first hinge clip includes a through-opening extending vertically through the first hinge clip, which is configured in size and shape for inserting the pole therethrough. The pole forms a hinge axis for hingedly rotating the first fence panel relative to the second fence panel.

In embodiments, the clip portion of the first hinge clip further includes a pocket in the first sidewall, wherein the deflectable end portion of the first hinge clip in a deflected position for assembly is deflected out of the slot and into the pocket.

The slot in the clip portion of the first hinge clip may further include a second sidewall opposite and parallel to the first sidewall and an access aperture extending through the second sidewall and an outer wall, the access aperture configured in use for inserting a tool therethrough to push the deflectable end portion out of the slot for removing the first hinge clip from the first fence panel.

In embodiments, each of the first fence panel and the second fence panel may further include at least one horizontal rod, wherein the slot in the clip portion of the first hinge clip further includes a second sidewall opposite and parallel to the first sidewall, and wherein the second sidewall includes a horizontal groove, the at least one horizontal rod being aligned in the horizontal groove of the first hinge clip that is removably connected to the first fence panel.

In embodiments, the system also includes a second hinge clip removably connected to the pole and to the second fence panel adjacent the pole, the second hinge clip including a positioning portion for inserting the pole therethrough and a clip portion removably connected to a portion of the second fence panel. The clip portion of the second hinge clip includes a slot with an open end configured to slide over a side of the second fence panel and a closed end forming an end wall of the slot; and a deflectable arm including an anchored end portion anchored to the clip portion along a second sidewall of the slot and proximate the open end and a deflectable end portion extending from the anchored end portion toward the end wall and protruding from the second sidewall and into the slot. A vertical channel is formed between the end wall of the slot and the deflectable end portion of the second hinge clip, the portion of the second fence panel to which the second hinge clip is removably connected being captured within the vertical channel of the clip portion of the second hinge clip.

In embodiments, each of the first fence panel and the second fence panel includes a plurality of vertical rods, and the portion of the first fence panel captured within the vertical channel of the first hinge clip is one of the plurality of vertical rods in the first fence panel, in embodiments, an outermost vertical rod of the first fence panel, and the portion of the second fence panel captured within the vertical channel of the second hinge clip is one of the plurality of vertical rods in the second fence panel, in embodiments, an outermost vertical rod of the second fence panel.

The first hinge clip, in embodiment, is identical in size and shape to the second hinge clip, and the first hinge clip is positioned on the first fence panel in inverted relationship to the second hinge clip on the second fence panel. The positioning portion of the pair of hinge clips, i.e., the first hinge clip and the second hinge clip, are assembled in vertical alignment, with the pole inserted through the positioning portion of both the first hinge clip and the second hinge clip.

Each of the first fence panel and the second fence panel in certain embodiments also includes at least one horizontal rod, wherein the slot in the clip portion of each of the first hinge clip and the second hinge clip further includes a second sidewall opposite and parallel to the first sidewall. The second sidewall of each of the first hinge clip and the second hinge clip includes a horizontal groove, the at least one horizontal rod of each of the first fence panel and the second fence panel being aligned in the horizontal groove of each of the first hinge clip and the second hinge clip. The at least one horizontal rod of the first fence panel is also horizontally aligned to the at least one horizontal rod of the second fence panel.

In further embodiments, the system further includes a base having a hollow receiver, wherein the pole is positioned and maintained in a vertical position within the hollow receiver, the base further including a base plate below the hollow receiver configured for stable positioning on a flat surface. Preferably, each pole in the fencing system is positioned in such a base with base plate.

A bottom of the base plate may include frictional elements forming a non-slip surface.

The hollow receiver, in embodiments of the base, may include a coiled spring compressible against a bottom surface of the hollow receiver, a track, and a side slot in an inner wall of the hollow receiver. The pole includes a depressible button configured to slide within the track, wherein compression and rotation of the pole within the hollow receiver positions the depressible button within the side slot to lock the pole in position in the base.

In further embodiments, the system may include a gate module removably connected to the first fence panel via a pair of hinge clips, each hinge clip of the pair being identical to the first hinge clip described above. The gate module further includes a first post configured with a latching system, a second post, an access fence panel hingedly connected to the second post and openable for access via the latching system on the first post, and a fence panel section connected along an outer edge of at least one of the first post and the second post. One hinge clip of the pair of hinge clips is removably connected to a portion of the access fence panel and the other hinge clip of the pair of hinge clips is removably connected to a portion of the first fence panel along a second side of the first fence panel, with an identical pole being inserted through the positioning portions of the pair of hinge clips.

The present disclosure is also directed to a modular fencing system which includes a fence panel and a gate module operatively and removably connected to the fence panel. The gate module includes a first post configured with a latching system, a second post, an access fence panel hingedly connected to the second post and openable for access via the latching system on the first post, and a fence panel section connected along an outer edge of one of the first post and the second post. The system also includes a pole operably connected to the fence panel and to the access fence panel, the pole being positioned between the fence panel and the access fence panel; and a first hinge clip removably connected to the pole and to the fence panel adjacent the pole. The first hinge clip includes a positioning portion for inserting the pole therethrough and a clip portion removably connected to a portion of the fence panel, wherein the clip portion includes a slot with an open end configured to slide over a side of the fence panel and a closed end forming an end wall of the slot, and a deflectable arm including an anchored end portion anchored to the clip portion along a first sidewall of the slot and proximate the open end and a deflectable end portion extending from the anchored end portion toward the end wall and protruding from the first sidewall and into the slot. A vertical channel is formed between the end wall of the slot and the deflectable end portion, the portion of the fence panel to which the first hinge clip is removably connected being captured within the vertical channel of the clip portion.

Each of the fence panel and the access fence panel, in embodiments, includes a plurality of vertical rods. The portion of the fence panel captured within the vertical channel of the first hinge clip in embodiments is one of the plurality of vertical rods in the fence panel, which may be an outermost vertical rod, and the portion of the access fence panel captured within the vertical channel of the second hinge clip may be one of the plurality of vertical rods in the access fence panel, which in embodiments is an outermost vertical rod of the access fence panel.

In further embodiments, the first hinge clip is identical in size and shape to the second hinge clip, and the first hinge clip is positioned on the fence panel in inverted relationship to the second hinge clip on the access fence panel with the positioning portion of each of the first hinge clip and the second hinge clip in vertical alignment. The pole is inserted through the positioning portion of both the first hinge clip and the second hinge clip.

Each of the fence panel and the access fence panel, in embodiments, further includes at least one horizontal rod, wherein the slot in the clip portion of each of the first hinge clip and the second hinge clip further includes a second sidewall opposite and parallel to the first sidewall, and wherein the second sidewall of each of the first hinge clip and the second hinge clip includes a horizontal groove. The at least one horizontal rod of each of the fence panel and the access fence panel are aligned in the horizontal groove of each of the first hinge clip and the second hinge clip, with the at least one horizontal rod of the fence panel being horizontally aligned to the at least one horizontal rod of the access fence panel.

The gate module may include a free-standing base attached to a bottom of each of the first post and the second post, wherein the gate module is free-standing and configured to be removed from the fence panel and reconnected to another fence panel in the modular fencing system.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

Figure 1A:
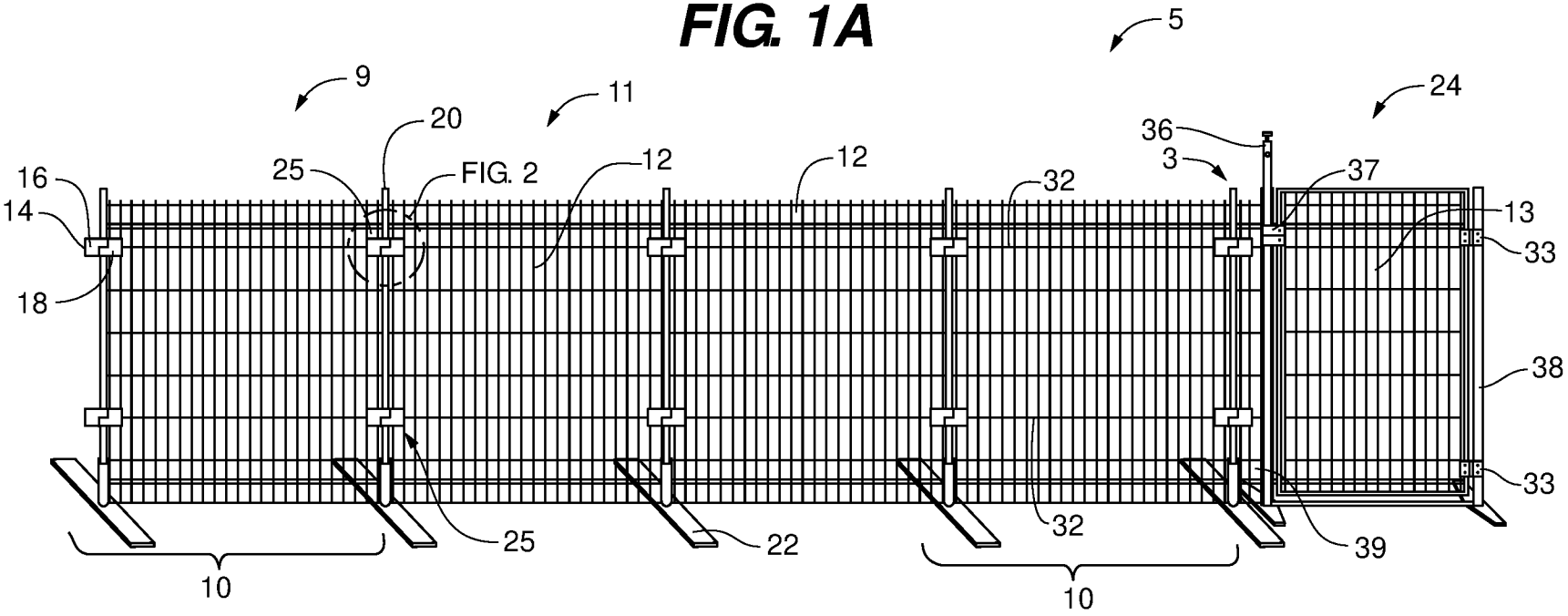
FIG. 1A is a pictorial representation of an embodiment of a modular fencing system of the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a modular fencing system, as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The term "wire" as used for wire mesh fences is used herein interchangeably with "rod" and refers to a sturdy metal, preferably steel, cylindrical or rectangular strip commonly used in the metallic fences described herein, and which are not easily bendable at room temperature.

The term "pole" may also be used herein interchangeably with "post" and refers to fencing posts or poles as known in the art for positioning between fence panels, although the posts, poles of the present disclosure are not cemented into the ground like those in conventional fencing systems.

The present disclosure is directed to a secure-access gated fencing system for preventing unwanted access to in-ground pools, for example. The system is a stand-alone and fully modular fencing system, which is installable and reconfigurable into any position or shape desired by a user without the need for any tools, and without damage to the surrounding ground or deck.

Referring to FIG. 1A, an embodiment of a fencing system 5 is shown for preventing unwanted access to an in-ground pool. The system 5 is preferably of modular design, assembled by interconnecting each of a plurality of fence modules 10 together in any shape and size chosen by the user. The system may also include a gate module 24 which may be incorporated between any adjacently positioned fence modules 10 to complete the fenced enclosure. For assembling the fencing system 5, each fence module 10 of the system 5 may include the following unitary elements, any of which may also be provided, or replaced, separately from the fence module 10: a fence panel 12; at least one pair of hinge clips 14; a pole 20; and a base 22, which is preferably self-standing.

Figure 2:
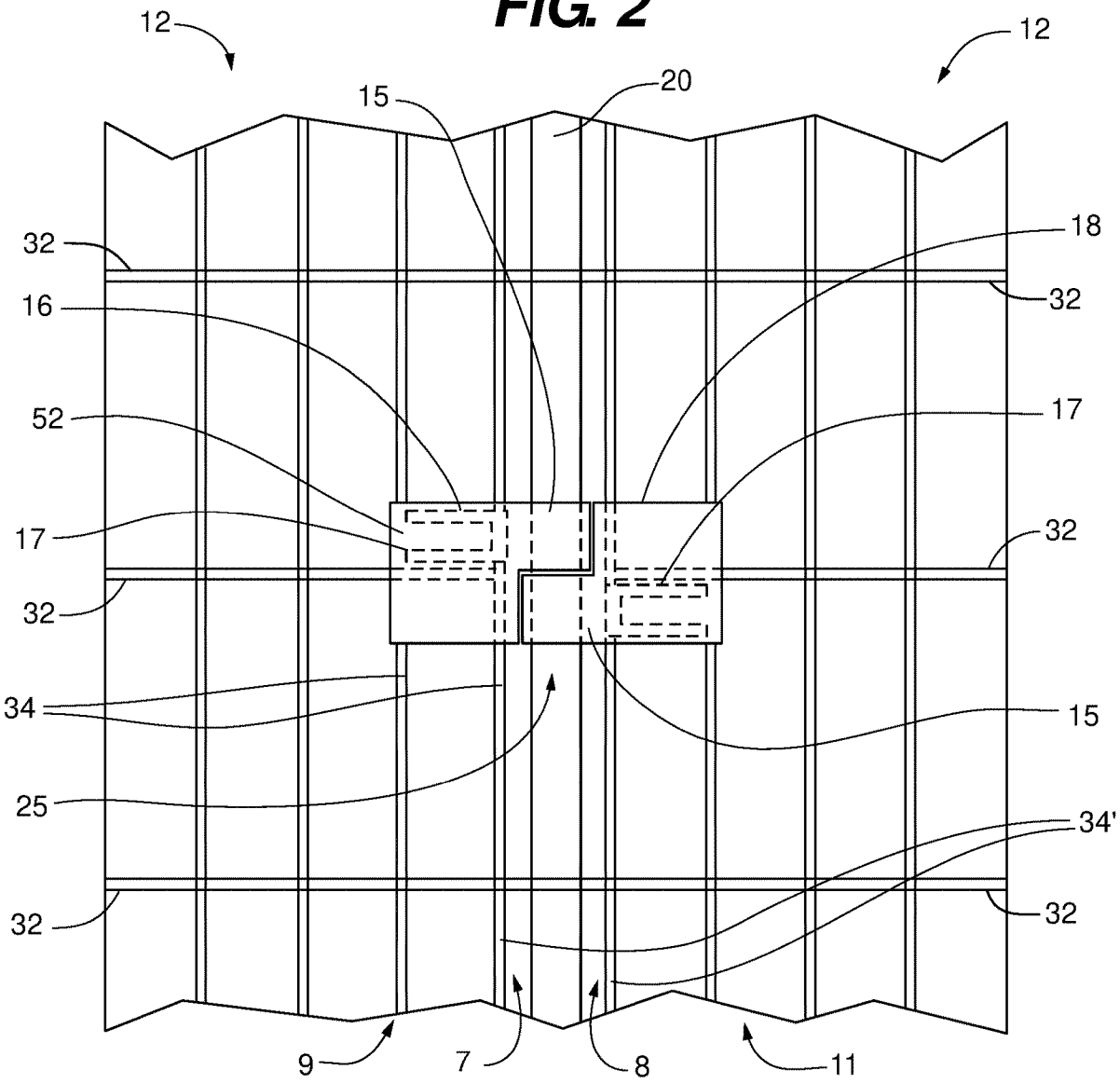
FIG. 2 is a pictorial representation of an embodiment of a pair of hinge clips connected to, and operatively connecting, adjacent fence panels in the system of FIG. 1A.

Still referring to FIG. 1A as well as FIG. 2, the present disclosure is also directed to a fencing system 5 which includes a plurality of fence panels 12, including a first fence panel 9 and a second fence panel 11 adjacent to the first fence panel 9, pole 20, and a pair of the hinge clips 14. The first fence panel 9 and the second fence panel 11 are adjoined via the hinge clips 14 and the pole 20, which is positioned between the first fence panel 9 and the second fence panel 11 via a pair of hinge clips 14. The hinge clips 14 are configured to be connected and disconnected, referred to herein as removably connected, to the fence panels 12 as needed, with each of the hinge clips 14 in the pair being attached to each of the first fence panel 9 and the second fence panel 11 along an adjoining side 7, 8, respectively, with the pole 20 being positioned through a pair of hinge clips 14.

Figure 1B:
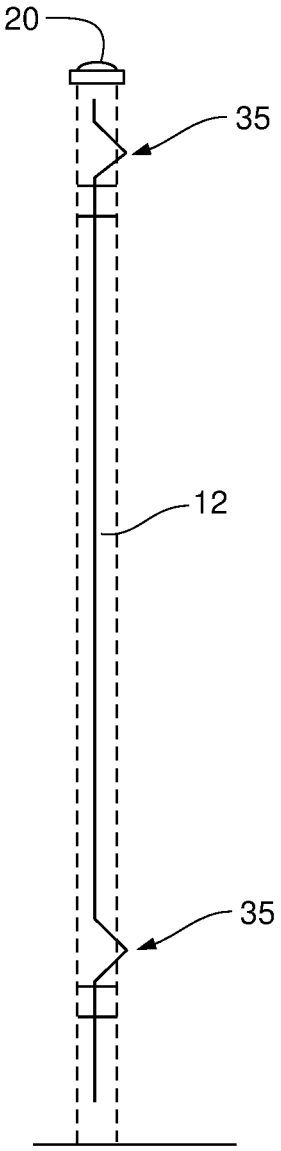
FIG. 1B is a side-view of an embodiment of a fence panel shown in FIG. 1A.

Referring also to FIG. 1B and FIG. 2, the fence panels 12 may be formed of a welded wire mesh, which may include vertical wires 34, and in embodiments, horizontal wires 32, and which in further aspects, may be formed of steel. The fence panels 12 may also include one or more indented or bent vertical wires 35, as shown in FIG. 1B. One type of fence panel 12 contemplated for use with the present system, for example, is a welded wire mesh panel sold under the tradename TUF-GRID® by Merchant Metals, Inc., Atlanta, Georgia. This type of fencing is much sturdier than typical pool fences, which are normally constructed of a mesh fabric (such as Textilene® fabrics). For example, the fence panels 12 may be constructed of galvanized, welded, black-powder coated steel, and may be at least 4 feet in height and 4 feet in width. The steel wire forming the steel mesh may be 6 mm (¼") or smaller in diameter, with a distance between the vertical wires 34 of about 2 inches, and a distance between the horizontal wires 32 of about 6 inches.

The base units 22 may also be formed of steel and can weigh about 20 pounds.

Figure 3A:
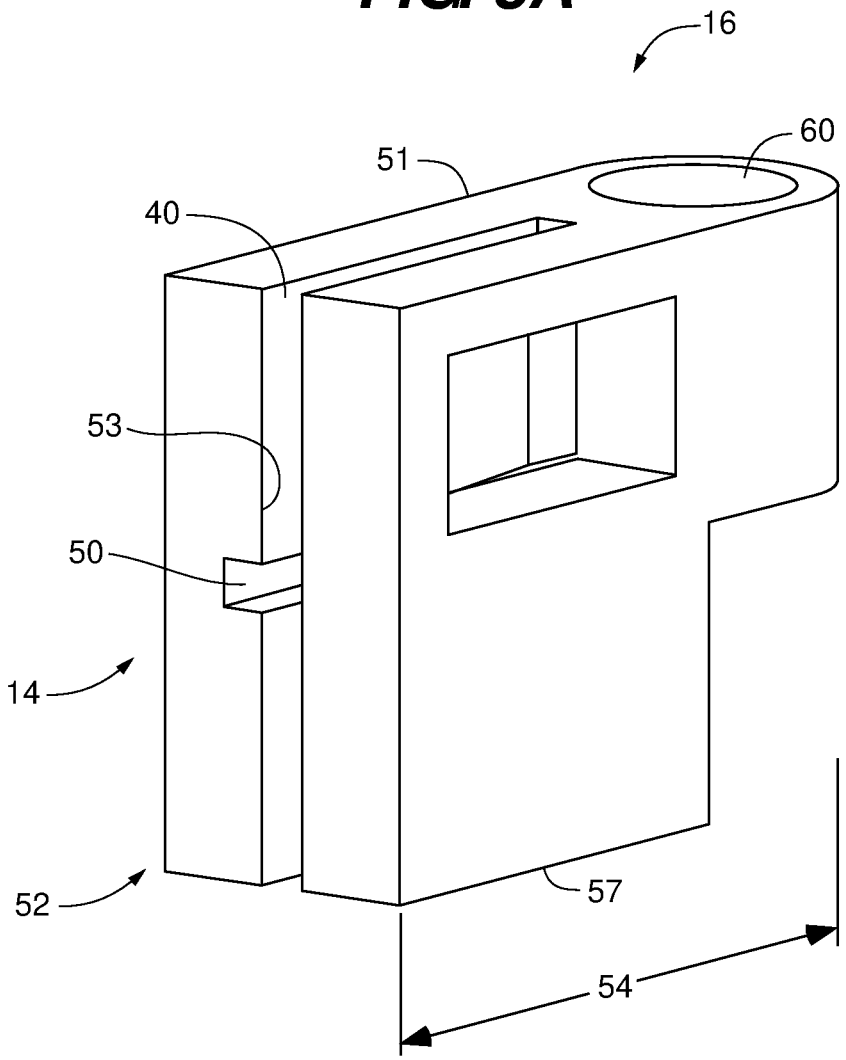
FIG. 3A is a perspective view of one of the hinge clips of the pair shown in FIG. 2, prior to assembly.
Figure 3B:
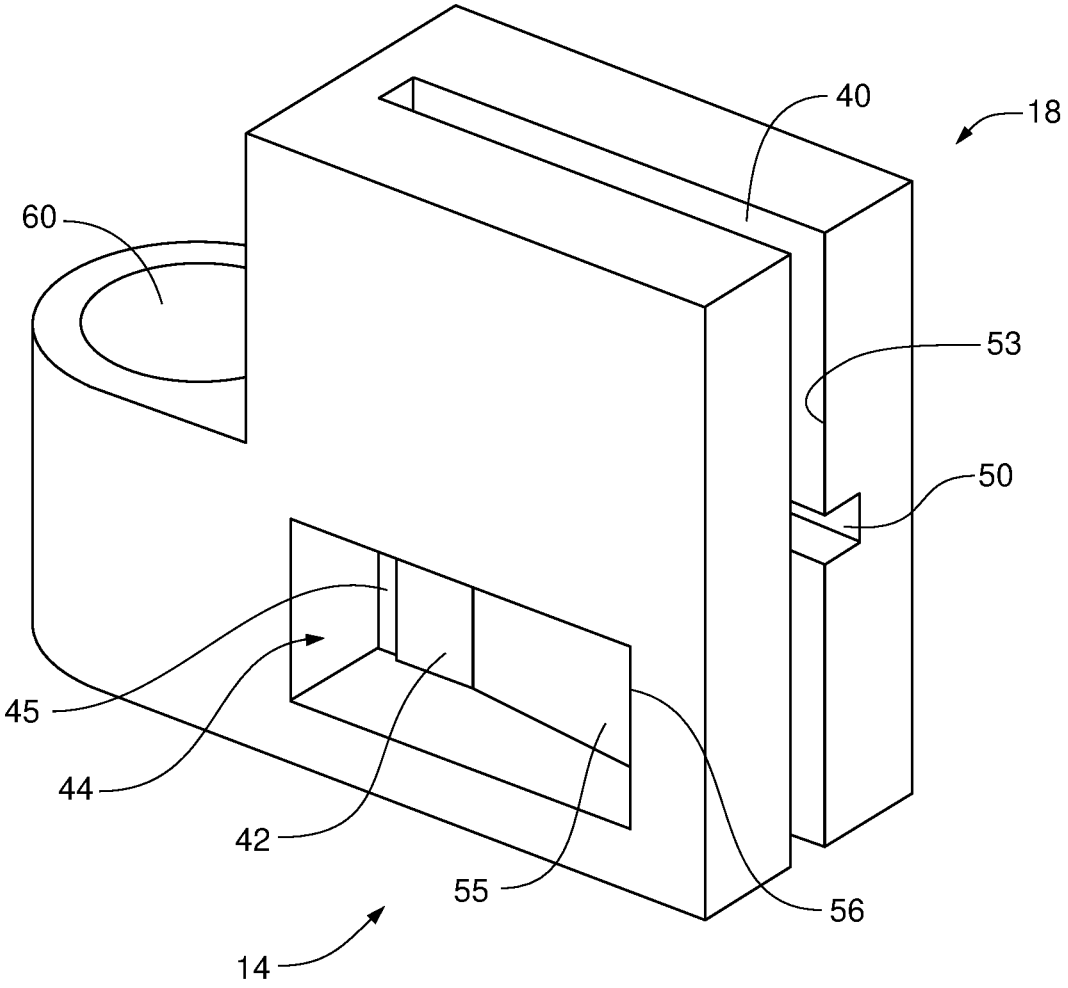
FIG. 3B is a perspective view of the hinge clip of FIG. 3A in an inverted position relative to FIG. 3A prior to assembly.

Referring still to FIG. 2, each hinge clip 14 is preferably formed as a body which includes a positioning portion 15 for inserting and positioning the (vertical) pole 20 therethrough and a clip portion 17 preferably configured for snap-fit assembly to the fence panel 12. In embodiments, the clip portion 17 is configured to clip onto one of the vertical rods 34, preferably an outermost vertical rod 34', of the fence panel 12. The positioning portion 15, as shown in FIGS. 3A, 3B, for example, includes a through-opening or through-hole 60, in embodiments, a cylindrical through-opening 60, sized and shaped for inserting a cylindrically-shaped pole therethrough and maintaining the pole 20 in a vertical, upright position, by providing an appropriate tolerance, for example, in an inner diameter of the through-opening 60 in comparison with the diameter of the pole 20. A height of the positioning portion 15 is also preferably sufficient to prevent the pole 20 from shifting substantially from the vertical, upright position.

It should be noted that while the embodiments described herein refer to poles that are cylindrical, rectangular poles are also within the scope of the disclosure along with an appropriately sized, rectangularly shaped through-opening 60 in the hinge clips 14.

The hinge clips 14 may be click-in or snap-fit type connectors, which can be assembled to the fence panel 12 by pushing and clicking the clip portion 17 of the hinge clip 14 into place onto a fence panel 12, e.g., over one of the vertical rods 34, preferably the outermost vertical rod 34', of the fence. The through-openings 60 of the pair of hinge clips 14 are vertically aligned to each other such that the pole 20 is insertable through both positioning portions 15 of the hinge clips. When properly assembled onto adjacent fence panels 9, 11, the hinge-clip units 14 are configured to both stably connect and hinge the two adjacent fence panels 9, 11 together, the fence panels 9, 11, with the pole 20 forming a hinge axis around which each of the fence panels 9, 11, can rotate via the hinge clips 14.

For example, still referring to FIG. 2, in embodiments, a pair 25 of hinge clips 14 assembled to adjoining fence panels 9, 11 include a first hinge clip 16 and a second hinge clip 18 connected, preferably removably connected, onto an adjoining side 7, 8 of each of the first fence panel 9 and the second fence panel 11, respectively, via the clip portion 17. Pole 20 is positioned through each of the first hinge clip 16 and the second hinge clip 18, which are vertically aligned with each other, with the adjoining fence panels 9, 11 connected thereto, to stably hinge together adjoined fence panels 9, 11.

In embodiments, as shown, the hinge clips 14 in each pair 25 of hinge clips 14 assembled on adjoining fence panels 9, 11 are preferably of identical shape, and are shaped and configured so that in an assembled position, one of them is inverted relative to the other, the positioning portion 15 of each of the first hinge clip 16 and the second hinge clip 18 provided in each pair 25 may abut each other. In addition, the positioning portion 15 of each hinge clip 14 of the pair 25 is aligned to accept the same pole 20 therethrough.

In embodiments, adjacent fence panels 9, 11, are rotatable by an amount greater than 270 degrees, and preferably by at least 315 degrees, and in further embodiments, rotatable by an amount between about 315 and about 360 degrees around the pole 20 captured within the pair 25 of hinge clips 14. Accordingly, the hinge clips 14 allow for easy directional change of any fence panel 12 wherever a pole 20 is located, and thus accommodates a user to change the shape of a fenced enclosure as desired.

In embodiments, the fencing system 5 also includes gate module 24. The gate module 24 is preferably a self-standing unit and forms a hinged barrier for access to the interior of the fenced area formed by the assembled fencing system 5. The gate module 24 is configured to be positioned anywhere in the system 10 using the same snap-fit components, i.e., is removably connectable to any fence panel 12 via the hinge clips 14, and may be positioned anywhere along the enclosure formed by the fencing system 5, and repositioned at any time. For example, referring to FIG. 1A and FIG. 2, a first (adjoining) side 7 of a fence panel 12 may be connected via a hinge clip 14 to an adjoining fence panel 12, while a second side 3 of the fence panel 12 may be removably connected to the gate module 24. As shown in FIG. 1A, for example, the gate module 24 may include an access fence panel 13 formed of any suitable type of fencing, e.g., a welded mesh, which may be the same type used for the fence panels 12. The gate module 24 may also include a first post 36, which may be configured with a latching system 37, in embodiments, and a second post 38, with hinged connectors 33, in embodiments, for hinged attachment to the access fence panel 13, the access fence panel 13 being hingedly rotatable around the second post 36 and openable for access by unlatching, via the latching system 37, the access fence panel 13 from the first post 36.

The gate module 24 also preferably includes a fence panel section 39 attached to each of the first post 36 and the second post 38 along its outer edge. The fence panel sections 39, like the fence panels 12, are configured to connect to an adjoining fence panel 12, via the hinge clips 14.

In one embodiment, the width of the door swing of the gate module 24 is about three (3) feet. In embodiments, the gate module 24 is a free-standing rigid U-frame with a vertical 1-inch square stock steel profile, connected by a low profile horizontal steel bar on the bottom (U-shape), and the hinged connectors 33 may be commercial hinges such as self-closing Tru-Close® hinges. The latching system 37 of the gate module 24 is preferably a self-latching device in accordance with required pool-fencing codes, e.g., a Magna-Latch® latching and locking system. The gate module 24 connects to the fencing modules 10 of the system 5 via the hinge clips 14.

As also shown, the posts 36, 38 of the gate module 24 may, in embodiments, be permanently connected to free-standing bases 22 as shown so that the only assembly required is to attach the modular gate 24 to adjacent fencing modules 10 via the hinge clips 14.

Figure 3C:
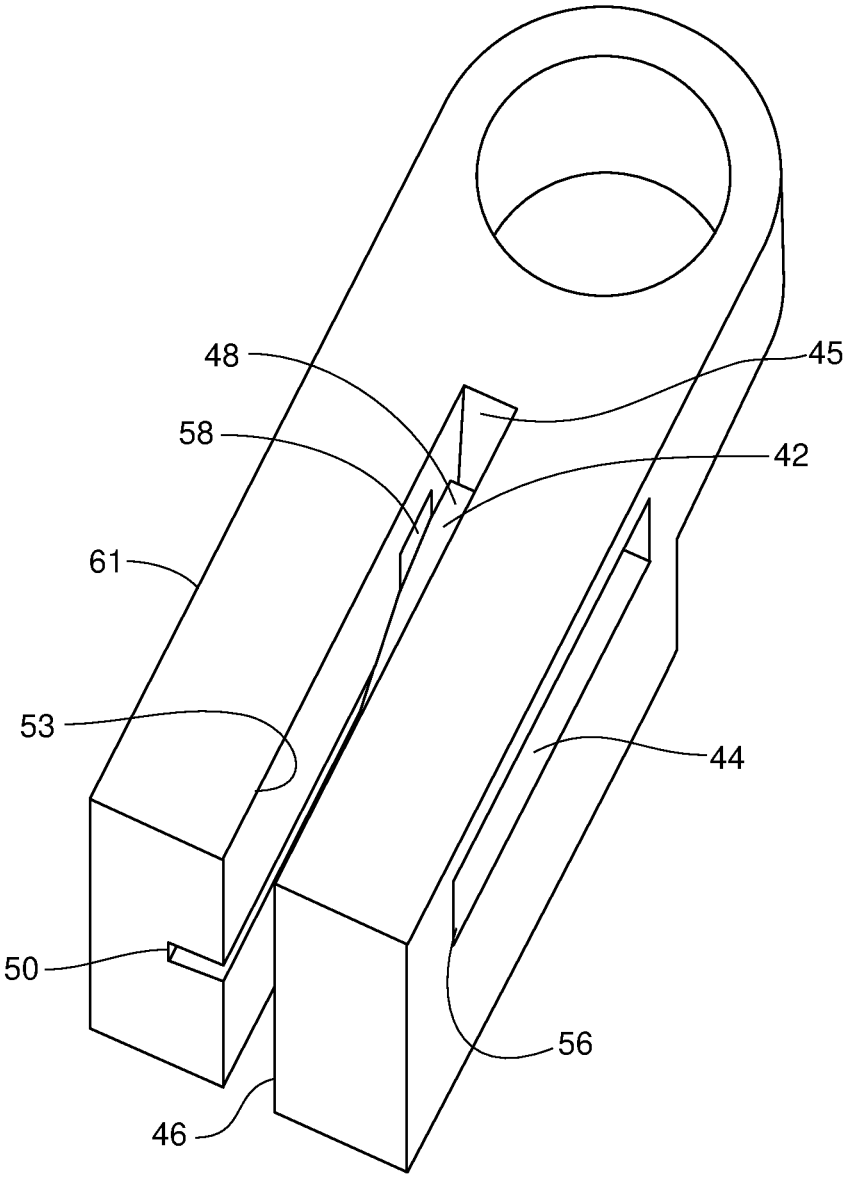
FIG. 3C is another perspective view of the hinge clip of FIG. 3A.
Figure 3D:
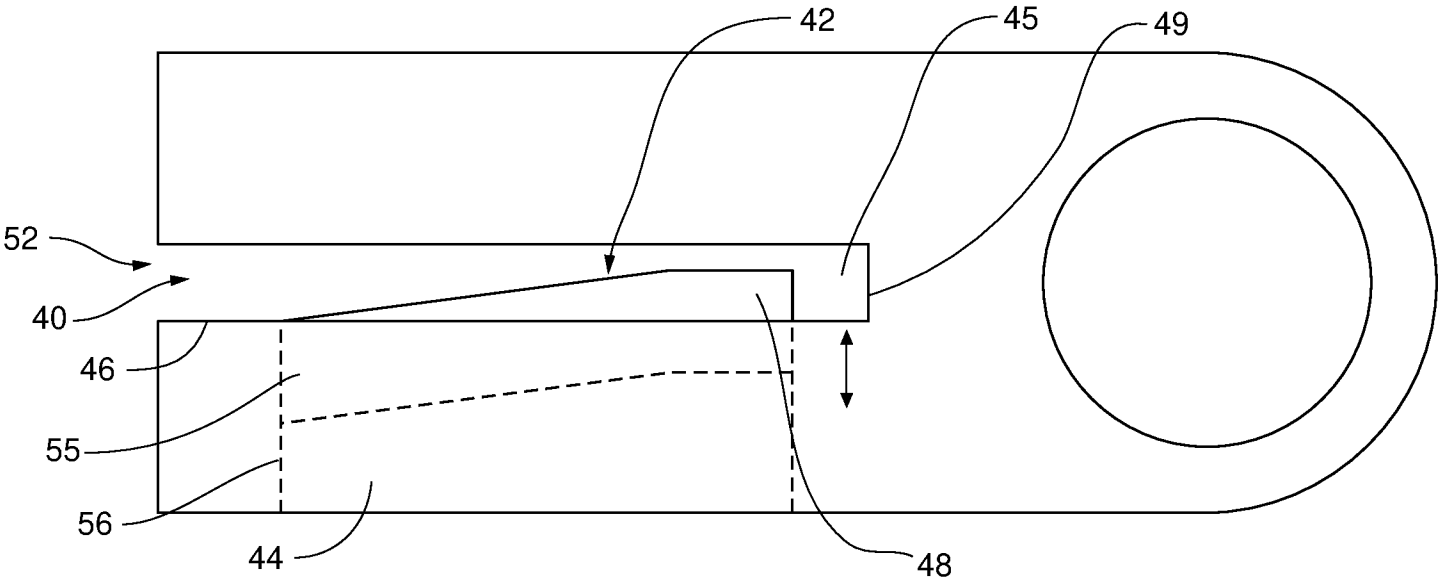
FIG. 3D is a top view of the hinge clip of FIG. 3A.

Referring to FIG. 3A, for example, each hinge clip 14 may include a slot 40, which may be in the form of a U-shaped cutout as shown, which extends vertically through each of a top 51 and a bottom end surface 57 of the hinge clip 14 (see FIG. 3A, e.g.) and from a panel-facing end (open end 52) of the clip portion 17 of the hinge clip 14, i.e., from the open end 52 of the slot 40, through a portion of a width 54 of the hinge clip 14 to a closed end 49, also referred to herein as the end wall 49 of the slot 40 as shown. Referring to FIGS. 3C and 3D, for snap-fit assembly, the clip portion 17 of each hinge clip 14, in embodiments, includes a deflectable arm 42, in the form of a cantilever, having a first, anchored, end portion 55 anchored to the clip portion 17, preferably along a first (inner) sidewall 46 of the slot 40, and proximate the open end 52 of the slot 40.

In embodiments, the first end portion 55 is anchored along a rear wall 56 of a pocket 44 formed in the first sidewall 46 of the slot 40, which is proximate the open end 52 of the slot 40. The deflectable arm 42 or cantilever 42 also includes a second, deflectable, end portion 48, which extends from the anchored end portion 55 toward the end wall 49, and which has a length less than a length of the slot 40. When in a resting position, i.e., in an assembled position of the hinge clip 14 onto the fence panel 12, the deflectable end portion 48 protrudes into the slot 40, forming a vertical channel 45 (see FIG. 3D) between the deflectable end portion 48 and the inner end wall 49 of the slot 40. The vertical channel 45 extends the full height of the slot 40, i.e., the vertical channel 45 extends vertically through both the top 51 and the bottom end surface 57 of the hinge clip 14 (see FIG. 3A).

Referring again to FIG. 2, the open end 52 (panel-facing) of the slot 40 in the clip portion 17 of the hinge clip 14 is configured to slide over and onto the adjoining side 7, for example, of the first fence panel 9 and pushed over and clipped onto a portion of the side of the fence panel 12, for example, in embodiments, onto the outermost vertical rod 34'. As shown in FIG. 2, the outermost vertical rod 34' of the fence panel 12, or adjacent fence panels 9, 11, is the one that is adjacent the pole 20 upon assembly of the first fence panel 9 to the second fence panel 11. In embodiments, the hinge clip 14 is assembled onto the outermost vertical rod 34' of the fence panel 12.

Referring also to FIGS. 3A-3C and 3E, a horizontal groove 50 is provided in a second (inner) sidewall 53 of the slot 40, which is opposite, and preferably parallel to, the first sidewall 46. The first sidewall 46 and the second sidewall 53 form vertical opposing walls of the slot 40 in an assembled position of the hinge clip 14 on the fence panel 12. In embodiments, the horizontal groove 50 of the hinge clip 14 is aligned with the horizontal rod 32, as shown in FIGS. 3A-3D, to guide the hinge clip 14 onto a horizontal position on the fence panel 12 that is determined by the position of the horizontal rod 32 as it is pushed into a locked position on the fence panel 12. In embodiments, the horizontal rod 32 on adjacent fence panels 9, 11 are horizontally aligned to each other, so that the pair 25 of hinge clips, with the first hinge clip 16 inverted relative to the second hinge clip 18 on adjacent fence panels 9, 11, are assembled in horizontal alignment, with each of the pair's horizontal groove 50 aligned with the respective horizontal rod 32 on adjacent fence panels.

In further embodiments, a vertical height (as assembled on the fence panel 12) of the positioning portion 15 is half a vertical height of the clip portion 17 of each hinge clip 14, so that the pair 25 of hinge clips 16, 18 assembled in inverted position to each other onto adjacent fence panels 9, 11, with each positioning portion 15 in vertical alignment, has the same vertical height as the clip portion 17, with the top surface 51 of the first hinge clip 16 being horizontally aligned with the bottom surface 52 of the second hinge clip 18. In embodiments, the positioning portion 15 of the first hinge clip 16 vertically abuts the second hinge clip 18.

The deflectable end portion 48 of the deflectable arm 42 protrudes into the slot 40 in its resting position, both in the unassembled position of the hinge clip 14, and the assembled position of the hinge clip 14. As the hinge clip 14 is pushed onto the outermost vertical rod 34' via the open end 52 of the slot 40, in embodiments, with the horizontal rod 32 guiding the horizontal position via the groove 50, the deflectable end portion 48 of the deflectable arm 42 is deflected outward from, and out of, the slot 40 as it is pushed against and impacts the outermost vertical rod 34'. While an inner side of the deflectable arm 42 within the slot 40 is in contact with the outermost vertical rod 34', i.e., in a deflected position of the hinge clip 14 for assembly, an outer side of the deflectable arm 42 is pushed further into the pocket 44. Once the deflectable end portion 48 clears, i.e., is pushed beyond the outermost vertical rod 34', the deflectable end portion 48 snaps back into its resting position, thus locking the outermost vertical rod 34' within the vertical channel 45. Once the vertical rod 34' is locked into the vertical channel 45, the hinge clip 14 is locked into position relative to the horizontal rod 32 and the vertical rod 34' and solidly connected to the fence panel 12. It cannot be displaced without manipulation of the positioning of the deflectable end portion 48. The deflectable arm 42, in embodiments, thus provides a snap-fit connector, in particular, a cantilever snap-fit connector, for securing the hinge clip 14 in position onto one of the vertical rods 34 of the fence panel 12.

Figure 3E:
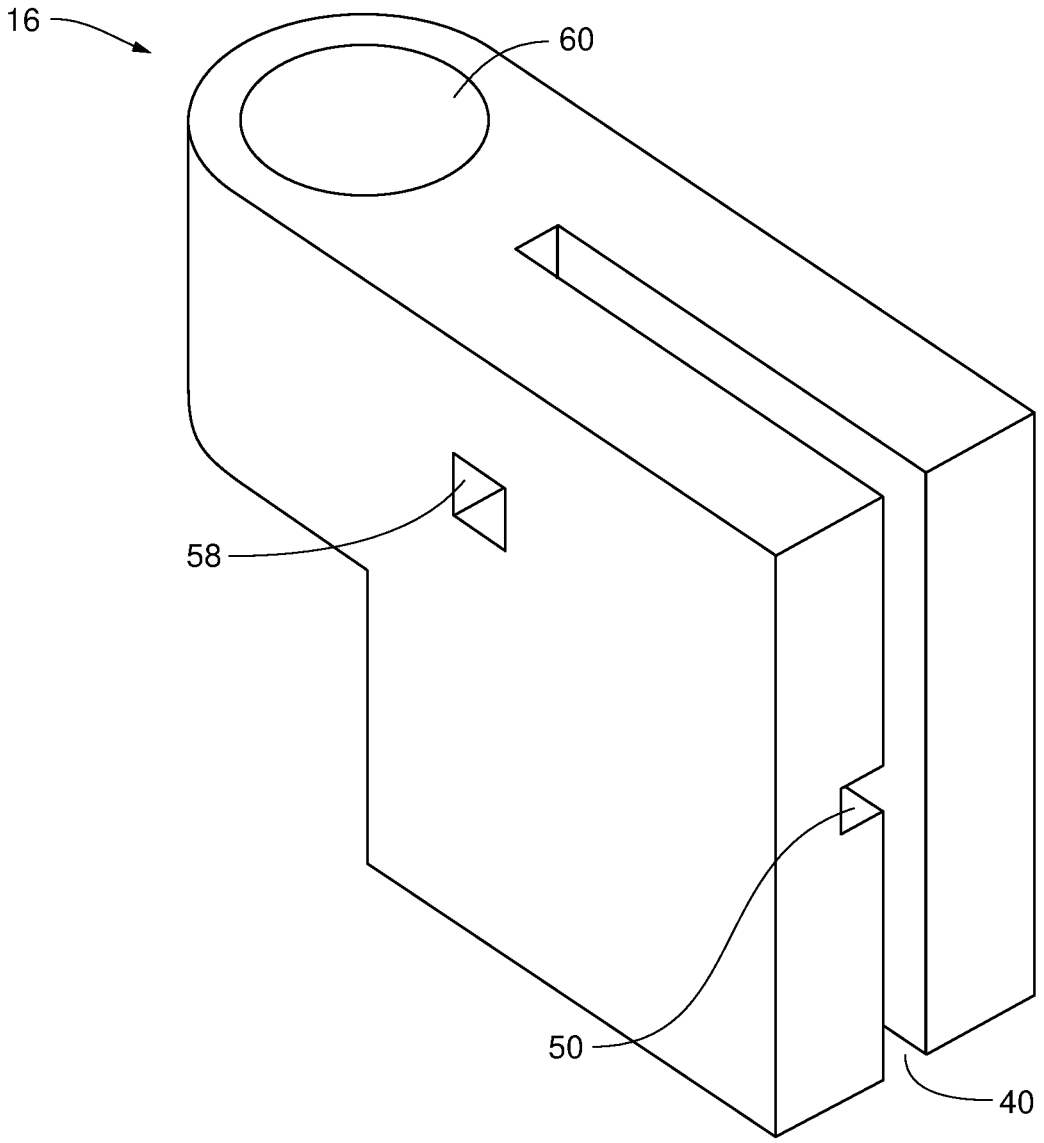
FIG. 3E is another perspective view of the hinge clip of FIG. 3A.

As best seen in FIG. 3C and FIG. 3E, an access aperture 58 may be provided in the second sidewall 53, which extends through to an outer wall 61, for insertion of any suitable device to push the deflectable arm 42, in embodiments, the deflectable end portion 48, out of its resting, or assembled, position. With the deflectable end portion 48 no longer protruding into and obstructing the slot 40, a pathway from the vertical channel 45 to the open end 52 of the slot 40 is provided for the hinge clip 14 to disengage from the outermost vertical rod 34' and be removed from the fence panel 12, as needed.

Figure 4A:
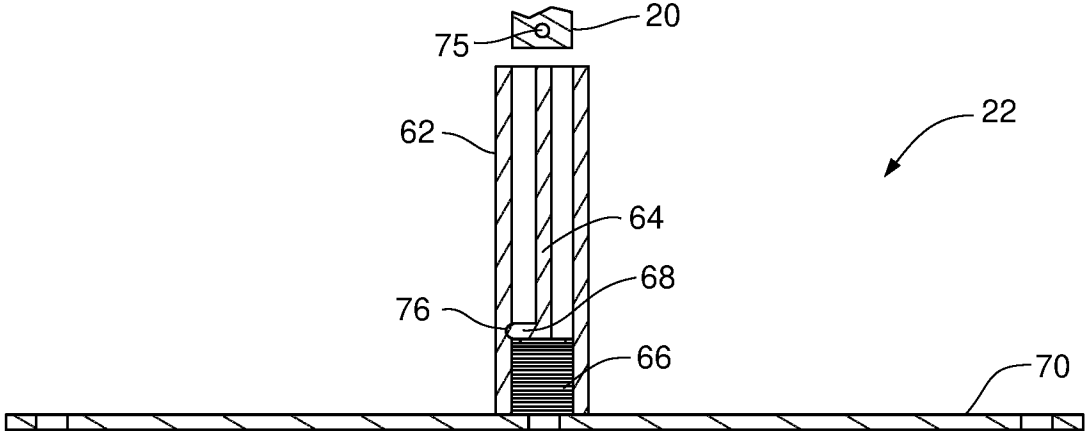
FIG. 4A is a cross-sectional view through an embodiment of a base of the modular fencing system.
Figure 4B:
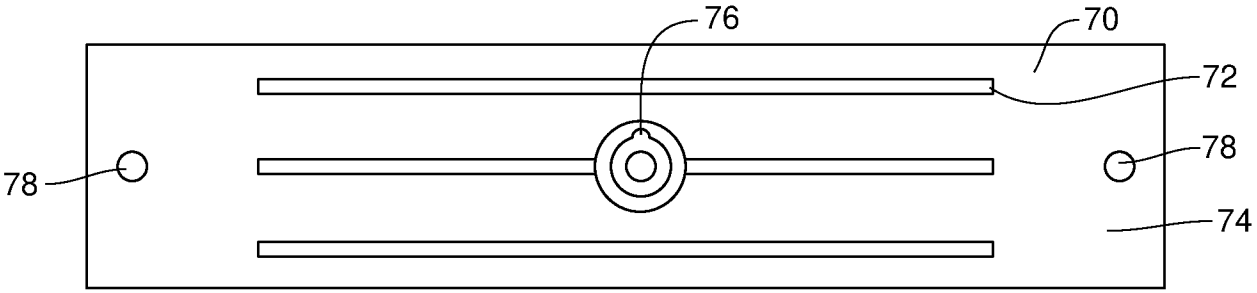
FIG. 4B is a top view of a horizontal portion of the base of FIG. 4A.

Referring again to FIG. 1A, together with FIGS. 4A and 4B, in embodiments, the base units 22 of the fencing system 5 are also configured to be easily assembled using click-in features. For example, base 22 may be configured to allow the pole 20 to be connected to base 22 by pushing down and rotating until clicking into place. In embodiments, the base 22 may include a hollow receiver 62 sized for accepting and holding the pole 20 upright, and which is attached to a base plate 70. The hollow receiver 62 includes a track 64 that extends vertically along an inner side wall of the receiver 62 and includes a horizontal portion 68 at its lower end that provides a path for a depressible button 75 on pole 20 to a slot or aperture 76 in the inner side wall, and a coiled spring 66 that is compressible against the bottom surface. In embodiments, each pole includes the depressible button 75 on its exterior side which is insertable into the track 64 in the receiver 62.

In embodiments, the base plate 70 is preferably wide and heavy, with a flat bottom surface for stably positioning on a flat surface such as a pool deck. In embodiments, the bottom of base plate 70 may include frictional elements 72 or a non-slip surface, such as a ribbed rubber surface 74. The ribbed rubber surface 74 minimizes or preferably prevents movement of the pool fence during windy conditions, provides proper electrical insulation, and safeguards against any friction damages and marring of a pool deck.

The base plate 70 may also include apertures 78 through which any appropriate type of anchoring device or spike may be inserted to anchor the base plates 70 to a ground surface, lawn or pool deck, as desired.

Once the pair 25 of hinge clips 16 and 18 are clipped onto two adjacent fence panels 9, 11 with one inverted in relation to the other as shown in FIG. 2, adjacent fence panels 9, 11 with the hinge clips 16, 18 connected thereto in inverted, and in embodiments, abutting, positions, are positioned so that the through-openings 60 in the pair 25 of hinge clips 14 are vertically co-aligned. The proper positioning of each of the hinge clips 16, 18 in inverted position, so that they abut and align when the fence panels 9, 11 are pushed together, is maintained by the positioning of the horizontal rod 32 in adjacent fence panels 9, 11 within the groove 50 of each hinge clip 14. With the hinge clips 16, 18 connected to each adjacent fence panels 9, 11 along co-aligned horizontal rods 32 in each adjacent fence panels 9, 11, the pole 20 is then positioned through both through-openings 60 provided in the pair 25 of hinge clips 14.

In embodiments, as shown in FIG. 1A, two pairs 25 of hinge clips 14 are preferably used to join each adjoining pair of fence panels 9, 11 for additional stability. The pole 20 is then assembled to the base 22 by pushing down and rotating until clicking into place. In operation, the pole 20 is pushed down to compress the coiled spring 66 and rotated or twisted by a set amount, e.g., 45 degrees, to lock the pole 20 in position on the base 22. In embodiments, the depressible button 75 is rotated with the rotation of the pole 20, until it is locked into the side slot or aperture 76 provided in the inner side wall of the hollow receiver 62, which, in embodiments may extend through to the outer wall.

Removal of the pole 20 is accomplished by pushing down and rotating in the opposite direction to release the depressible button 75 on the pole 20 from its locked position within the base 22. The spring 66 also pushes the pole slightly upward so that it may be easily removed.

The poles 20, in embodiments, may be round and about 1-inch in diameter, and in further embodiments, at least 4 feet in height. The poles 20 may, in embodiments, be constructed of aluminum, e.g., extruded aluminum, or fiberglass.

The hinge clips 14, in embodiments, may be made of injection molded plastic. In embodiments, the hinge clips 14 are configured to accommodate any welded fence panel with wiring smaller than 6 mm and greater than 3 mm.

While particular embodiments of the present disclosure have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments may fall within the scope of the accompanying claims and equivalents thereto.

What is claimed is:

1. A modular fencing system, comprising:

a first fence panel and a second fence panel adjacent the first fence panel;

a pole operably connected to the first fence panel and to the second fence panel, the pole being positioned between the first fence panel and the second fence panel;

a first hinge clip removably connected to the pole and to the first fence panel adjacent the pole, the first hinge clip including a positioning portion for inserting the pole therethrough and a clip portion removably connected to a portion of the first fence panel; and a base having a hollow receiver, wherein the pole is positioned and maintained in a vertical position within the hollow receiver, the base further including a base plate below the hollow receiver configured for stable positioning on a flat surface, and wherein the hollow receiver includes a coiled spring compressible against a bottom surface of the hollow receiver, a track, and a side slot in an inner wall of the hollow receiver, the pole including a depressible button configured to slide within the track, wherein compression and rotation of the pole within the hollow receiver positions the depressible button within the side slot to lock the pole in position in the base;

wherein the clip portion of the first hinge clip includes a slot with an open end configured to slide over a first side of the first fence panel and a closed end forming an end wall of the slot, and a deflectable arm including an anchored end portion anchored to the clip portion along a first sidewall of the slot and proximate the open end and a deflectable end portion extending from the anchored end portion toward the end wall and protruding from the first sidewall and into the slot, wherein a vertical channel is formed between the end wall of the slot and the deflectable end portion, the portion of the first fence panel to which the first hinge clip is removably connected being captured within the vertical channel of the clip portion.

2. The modular fencing system of claim 1, wherein the first fence panel includes a plurality of vertical rods, and wherein the portion of the first fence panel captured within the vertical channel is one of the plurality of vertical rods.

3. The modular fencing system of claim 2, wherein each of the first fence panel and the second fence panel further includes at least one horizontal rod, wherein the slot in the clip portion of the first hinge clip further includes a second sidewall opposite and parallel to the first sidewall, and wherein the second sidewall includes a horizontal groove, the at least one horizontal rod being aligned in the horizontal groove of the first hinge clip that is removably connected to the first fence panel.

4. The modular fencing system of claim 1, wherein the positioning portion includes a through-opening extending vertically through the first hinge clip, the through-opening configured in size and shape for inserting the pole therethrough, and wherein the pole forms a hinge axis for hingedly rotating the first fence panel relative to the second fence panel.

5. The modular fencing system of claim 1, the clip portion of the first hinge clip further including a pocket in the first sidewall, wherein the deflectable end portion of the first hinge clip in a deflected position for assembly is deflected out of the slot and into the pocket.

6. The modular fencing system of claim 1, the slot in the clip portion of the first hinge clip further including a second sidewall opposite and parallel to the first sidewall and an access aperture extending through the second sidewall and an outer wall, the access aperture configured in use for inserting a tool therethrough to push the deflectable end portion out of the slot for removing the first hinge clip from the first fence panel.

7. The modular fencing system of claim 1, further including:

a second hinge clip removably connected to the pole and to the second fence panel adjacent the pole, the second hinge clip including a positioning portion for inserting the pole therethrough and a clip portion removably connected to a portion of the second fence panel, wherein the clip portion of the second hinge clip includes a slot with an open end configured to slide over a side of the second fence panel and a closed end forming an end wall of the slot, and a deflectable arm including an anchored end portion anchored to the clip portion along a second sidewall of the slot and proximate the open end and a deflectable end portion extending from the anchored end portion toward the end wall and protruding from the second sidewall and into the slot, wherein a vertical channel is formed between the end wall of the slot and the deflectable end portion of the second hinge clip, the portion of the second fence panel to which the second hinge clip is removably connected being captured within the vertical channel of the clip portion of the second hinge clip.

8. The modular fencing system of claim 7, wherein each of the first fence panel and the second fence panel includes a plurality of vertical rods, and wherein the portion of the first fence panel captured within the vertical channel of the first hinge clip is one of the plurality of vertical rods in the first fence panel, and the portion of the second fence panel captured within the vertical channel of the second hinge clip is one of the plurality of vertical rods in the second fence panel.

9. The modular fencing system of claim 8, wherein the first hinge clip is identical in size and shape to the second hinge clip, and wherein the first hinge clip is positioned on the first fence panel in inverted relationship to the second hinge clip on the second fence panel with the positioning portion of each of the first hinge clip and the second hinge clip in vertical alignment, with the pole inserted through the positioning portion of both the first hinge clip and the second hinge clip.

10. The modular fencing system of claim 9, wherein each of the first fence panel and the second fence panel further includes at least one horizontal rod, wherein the slot in the clip portion of each of the first hinge clip and the second hinge clip further includes a second sidewall opposite and parallel to the first sidewall, and wherein the second sidewall of each of the first hinge clip and the second hinge clip includes a horizontal groove, the at least one horizontal rod of each of the first fence panel and the second fence panel being aligned in the horizontal groove of each of the first hinge clip and the second hinge clip, the at least one horizontal rod of the first fence panel being horizontally aligned to the at least one horizontal rod of the second fence panel.

11. The modular fencing system of claim 1, wherein a bottom of the base plate includes frictional elements forming a non-slip surface.

12. The modular fencing system of claim 1, further including a gate module removably connected to the first fence panel via a pair of hinge clips, each of the pair being identical to the first hinge clip, the gate module further comprising a first post configured with a latching system, a second post, an access fence panel hingedly connected to the second post and openable for access via the latching system on the first post, and a fence panel section connected along an outer edge of at least one of the first post and the second post, a first of the pair of hinge clips being removably connected to a portion of the access fence panel and a second of the pair of hinge clips being removably connected to a portion of the first fence panel along a second side of the first fence panel, with an identical pole being inserted through the positioning portions of the pair of hinge clips.

13. A modular fencing system, comprising:

a fence panel;

a gate module operatively and removably connected to the fence panel, the gate module including a first post configured with a latching system, a second post, an access fence panel hingedly connected to the second post and openable for access via the latching system on the first post, and a fence panel section connected along an outer edge of one of the first post and the second post;

a pole operably connected to the fence panel and to the access fence panel, the pole being positioned between the fence panel and the access fence panel;

a first hinge clip removably connected to the pole and to the fence panel adjacent the pole, the first hinge clip including a positioning portion for inserting the pole therethrough and a clip portion removably connected to a portion of the fence panel, wherein the clip portion includes a slot with an open end configured to slide over a side of the fence panel and a closed end forming an end wall of the slot, and a deflectable arm including an anchored end portion anchored to the clip portion along a first sidewall of the slot and proximate the open end and a deflectable end portion extending from the anchored end portion toward the end wall and protruding from the first sidewall and into the slot, wherein a vertical channel is formed between the end wall of the slot and the deflectable end portion, the portion of the fence panel to which the first hinge clip is removably connected being captured within the vertical channel of the clip portion; and a base having a hollow receiver, wherein the pole is positioned and maintained in a vertical position within the hollow receiver, the base further including a base plate below the hollow receiver configured for stable positioning on a flat surface, and wherein the hollow receiver includes a coiled spring compressible against a bottom surface of the hollow receiver, a track, and a side slot in an inner wall of the hollow receiver, the pole including a depressible button configured to slide within the track, wherein compression and rotation of the pole within the hollow receiver positions the depressible button within the side slot to lock the pole in position in the base.

14. The modular fencing system of claim 13, further including:

a second hinge clip removably connected to the pole and to the access fence panel adjacent the pole, the second hinge clip including a positioning portion for inserting the pole therethrough and a clip portion removably connected to a portion of the access fence panel, wherein the clip portion of the second hinge clip includes a slot with an open end configured to slide over a side of the access fence panel and a closed end forming an end wall of the slot, and a deflectable arm including an anchored end portion anchored to the clip portion along a second sidewall of the slot and proximate the open end and a deflectable end portion extending from the anchored end portion toward the end wall and protruding from the second sidewall and into the slot, wherein a vertical channel is formed between the end wall of the slot and the deflectable end portion of the second hinge clip, the portion of the access fence panel to which the second hinge clip is removably connected being captured within the vertical channel of the clip portion of the second hinge clip.

15. The modular fencing system of claim 14, wherein each of the fence panel and the access fence panel includes a plurality of vertical rods, and wherein the portion of the fence panel captured within the vertical channel of the first hinge clip is one of the plurality of vertical rods in the fence panel, and the portion of the access fence panel captured within the vertical channel of the second hinge clip is one of the plurality of vertical rods in the access fence panel.

16. The modular fencing system of claim 15, wherein the first hinge clip is identical in size and shape to the second hinge clip, and wherein the first hinge clip is positioned on the fence panel in inverted relationship to the second hinge clip on the access fence panel with the positioning portion of each of the first hinge clip and the second hinge clip in vertical alignment, with the pole inserted through the positioning portion of both the first hinge clip and the second hinge clip.

17. The modular fencing system of claim 16, wherein each of the fence panel and the access fence panel further includes at least one horizontal rod, wherein the slot in the clip portion of each of the first hinge clip and the second hinge clip further includes a second sidewall opposite and parallel to the first sidewall, and wherein the second sidewall of each of the first hinge clip and the second hinge clip includes a horizontal groove, the at least one horizontal rod of each of the fence panel and the access fence panel being aligned in the horizontal groove of each of the first hinge clip and the second hinge clip, the at least one horizontal rod of the fence panel being horizontally aligned to the at least one horizontal rod of the access fence panel.

18. The modular fencing system of claim 13, wherein the gate module includes a free-standing base attached to a bottom of each of the first post and the second post, wherein the gate module is free-standing and configured to be removed from the fence panel and reconnected to another fence panel in the modular fencing system.

* * * * *